US009746189B2

(12) United States Patent
Kantas

(10) Patent No.: US 9,746,189 B2
(45) Date of Patent: Aug. 29, 2017

(54) OVEN WITH INCREASED COOKING EFFICIENCY

(71) Applicant: Arcelik Anonim Sirketi, Istanbul (TR)

(72) Inventor: Murat Kantas, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 490 days.

(21) Appl. No.: 14/350,354

(22) PCT Filed: Oct. 5, 2012

(86) PCT No.: PCT/EP2012/069749
§ 371 (c)(1),
(2) Date: Apr. 7, 2014

(87) PCT Pub. No.: WO2013/050546
PCT Pub. Date: Apr. 11, 2013

(65) Prior Publication Data

US 2014/0231407 A1 Aug. 21, 2014

(30) Foreign Application Priority Data

Oct. 6, 2011 (TR) ..... A 2011/09916

(51) Int. Cl.
*F24C 15/18* (2006.01)
*H05B 6/02* (2006.01)
*F24C 15/32* (2006.01)

(52) U.S. Cl.
CPC ..... *F24C 15/325* (2013.01); *F24C 15/18* (2013.01)

(58) Field of Classification Search
CPC ..... F24C 15/32; F24C 15/322; F24C 15/325; F24C 15/18; F24C 15/006; H05B 6/02
See application file for complete search history.

(56) References Cited

U.S. PATENT DOCUMENTS

| | | | | |
|---|---|---|---|---|
| 4,780,597 | A * | 10/1988 | Linhart | F24C 15/166 219/396 |
| 2006/0289435 | A1* | 12/2006 | Park | F24C 15/322 219/394 |
| 2008/0149088 | A1 | 6/2008 | Inada et al. | |
| 2008/0308545 | A1 | 12/2008 | Kim et al. | |
| 2009/0013981 | A1 | 1/2009 | Yuasa | |
| 2009/0090347 | A1 | 4/2009 | Kim et al. | |

FOREIGN PATENT DOCUMENTS

| | | | |
|---|---|---|---|
| EP | 1715251 | A1 | 10/2006 |
| EP | 1732359 | A2 | 12/2006 |
| EP | 2003400 | A2 | 12/2008 |
| EP | 2048442 | A2 | 4/2009 |
| JP | 58193031 | A | 11/1983 |
| WO | 2005066549 | A1 | 7/2005 |
| WO | 2008148846 | A1 | 12/2008 |

* cited by examiner

*Primary Examiner* — Brian Jennison
(74) *Attorney, Agent, or Firm* — Kilpatrick Townsend & Stockton LLP

(57) ABSTRACT

The oven (1) of the present invention comprises a rear wall (4) that separates the cooking chamber (2) and the volume wherein the fan (3) is situated, a separator (5) which is located on the rear wall (4) and separates the cooking chamber (2) into two, and two side walls (8) having at least one passage (7) that provides air delivery into the cooking chamber (2).

12 Claims, 4 Drawing Sheets

OVEN WITH INCREASED COOKING EFFICIENCY

Figure 1:
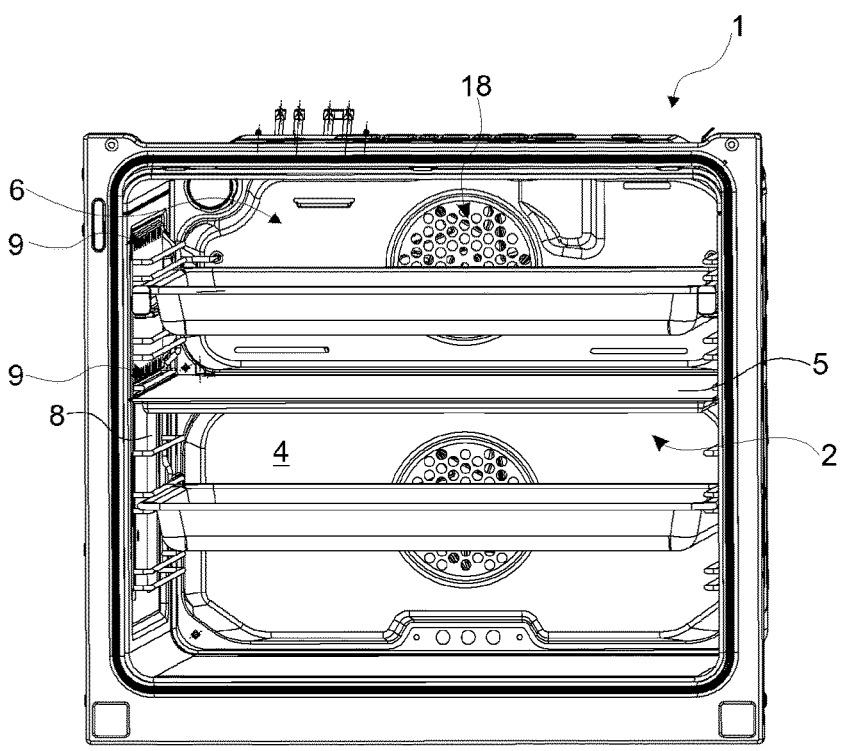

The present invention relates to an oven wherein the air flow is controlled.

At least one heater and a fan are situated in ovens wherein the cooking process is performed by means of convection. The air heated by the heater is propelled by the fan and delivered into the cooking chamber by means of the holes formed on the rear wall and the food is provided to be cooked as a result of the heat transfer formed between the hot air and the food desired to be cooked.

In the state of the art embodiments, separators are explained that divide the cooking volume into at least two compartments for providing the food with different features to be cooked simultaneously or, by dividing the volume, the cooking to be performed in a smaller volume instead of heating the entire cooking volume.

In the state of the art Japanese Patent Application No. JP58193031, an oven is explained comprising a shutter that is triggered by an extension on the separator and that opens/closes the hole on the rear wall.

In the state of the art International Patent Application No. WO2008148846, an oven is explained having a separator which divides the cooking chamber into two compartments, a trigger which is located on the separator and an air distribution mechanism which provides the suction holes to be closed when the separator is placed into the cooking chamber.

In the state of the art, the cooking process is provided to be performed in the cooking chamber divided into two by the separator, in a volume determined by the producer.

The aim of the present invention is the realization of an oven wherein, in the cooking volume divided into more than one compartment, the air flow is provided into the separated compartments in a controlled manner.

The oven realized in order to attain the aim of the present invention, explicated in the first claim and the respective claims thereof, comprises a cooking chamber, a side wall having at least one blowing hole that provides air to be delivered to the cooking chamber, a separator that separates the cooking chamber into two separate volumes, at least two compartments formed as a result of the separation of the cooking chamber by means of the separator, a cooking chamber wall that has at least one passage which provides the air propelled by the fan to be delivered to the side blowing holes, and at least one lid that provides the front of the passage to be opened when the separator is placed into the cooking chamber, and the front of the passage to be closed when the separator is removed from the cooking chamber.

The oven volume is divided into two by means of the separator in order that the odors of the foods do not mingle with each other while cooking or that the foods are cooked under different conditions. While the separator is placed into the cooking chamber, the lid moves away from the front of the passage and the air directed by the fan is provided to be delivered into the cooking chamber from the sides. Air is provided to be blown into the cooking chamber through the side walls. Thus, the food placed in the compartment is provided to be cooked more effectively. The air directed into the cooking chamber through the blowing holes is prevented from passing into the other compartment by means of the separator.

In an embodiment of the present invention, the oven comprises at least one shaft that provides the lid to be moved and at least one triggering arm that extends from the shaft in the horizontal direction. While being placed into the cooking chamber, the separator bears against the triggering arm and moves the triggering arm. Connected to the triggering arm, the shaft rotates, too, and provides the lid to be moved by rotating. Thus, the passage is opened.

In an embodiment of the present invention, the rear wall comprises a recess wherein the triggering arm is inserted. By the triggering arm being almost completely seated into the recess, the separator is completely inserted into the cooking chamber.

In an embodiment of the present invention, the oven comprises at least one shaft that has a certain angle with respect to the triggering arm.

In an embodiment of the present invention, the oven comprises at least one connection member that extends from the shaft to the cooking chamber wall. The connection member provides the shaft to be placed rigidly into the cooking chamber. The connection member is a stationary element.

In an embodiment of the present invention, the oven comprises at least one intermediate member that extends from the lid towards the connection member.

In an embodiment of the present invention, the oven comprises at least one resilient member located between the lid and the connection member. The resilient member is compressed while the separator is placed into the cooking chamber. The compressed resilient member stretches and provides the lid to be moved while the separator is removed from the cooking chamber.

In an embodiment of the present invention, the oven comprises at least one holder which is located on the connection member and through which the shaft passes, and which provides the shaft to be mounted to the connection member.

By means of the present invention, an oven is realized, which provides the air to be blown onto the food both from the sides and from the back by means of the blowing holes that are located in the compartment separated by the separator, and which provides the food to be cooked homogeneously.

An oven realized in order to attain the aim of the present invention is illustrated in the attached figures, where:

FIG. 1—is the front view of an oven.

Figure 2:
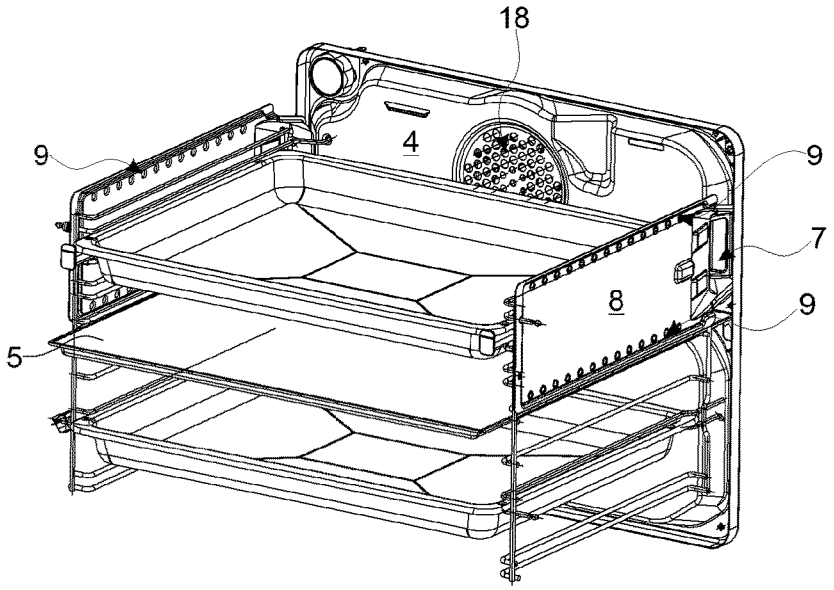

FIG. 2—is the perspective view of the oven wherein a separator is placed.

Figure 3:
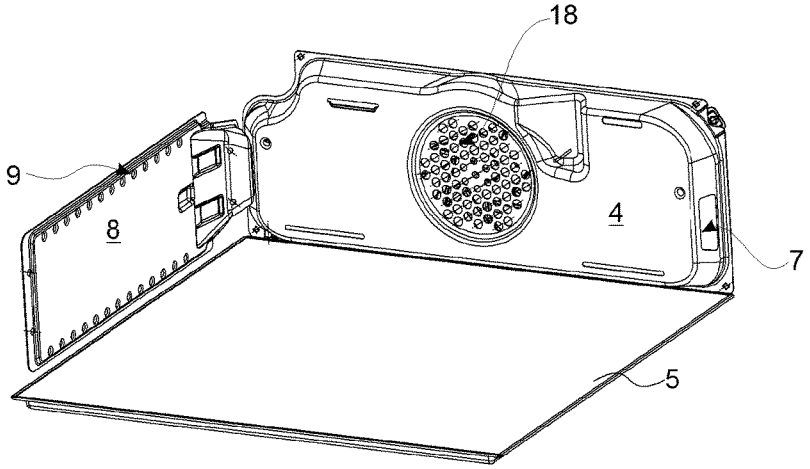

FIG. 3—is the front perspective view of a compartment.

Figure 4:
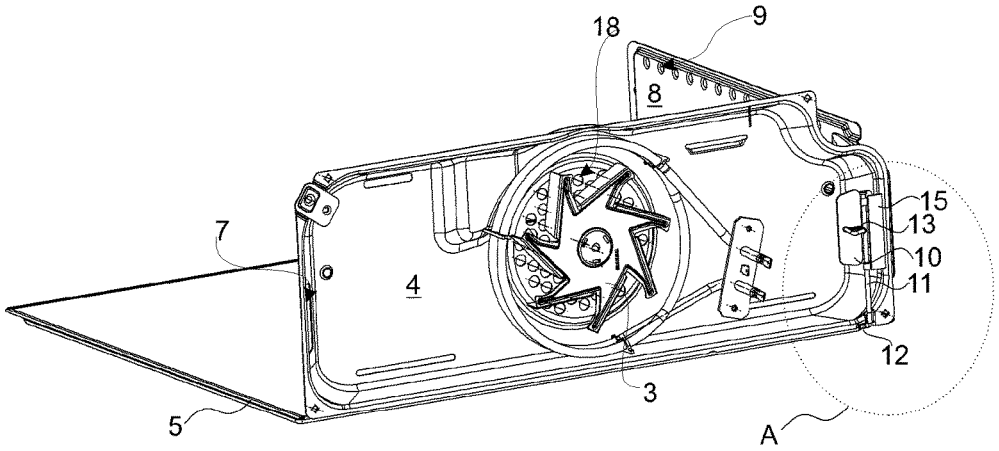

FIG. 4—is the rear view of a compartment.

Figure 5:
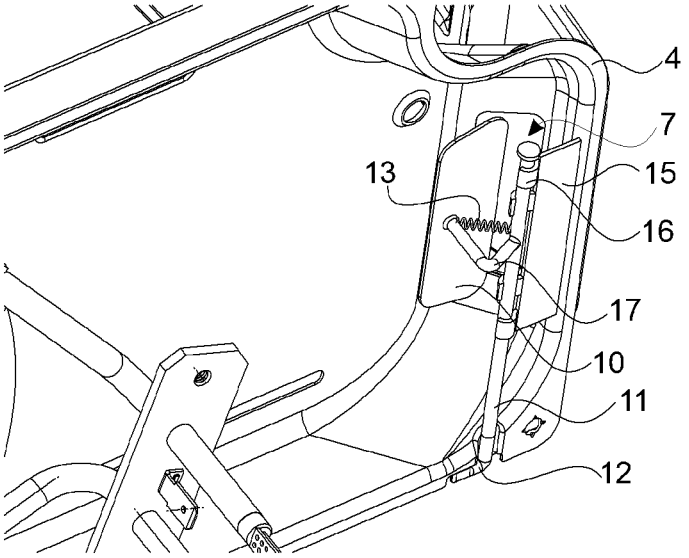

FIG. 5—is the view of detail A in FIG. 3.

Figure 6:
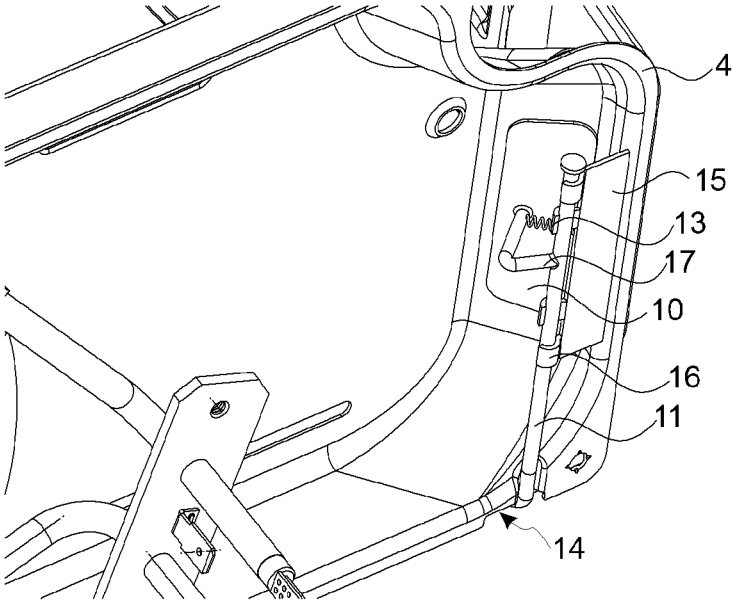

FIG. 6—is the view of the rear wall, the lid, the shaft, the connection member and the resilient member when the front of the passage is closed.

Figure 7:
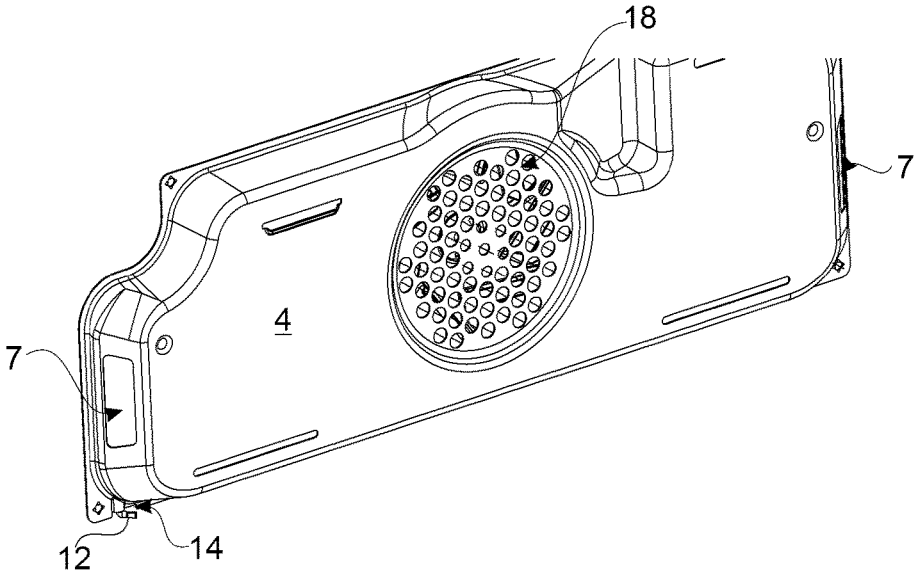

FIG. 7—is the rear view of the rear wall when the front of the passage is open.

Figure 8:
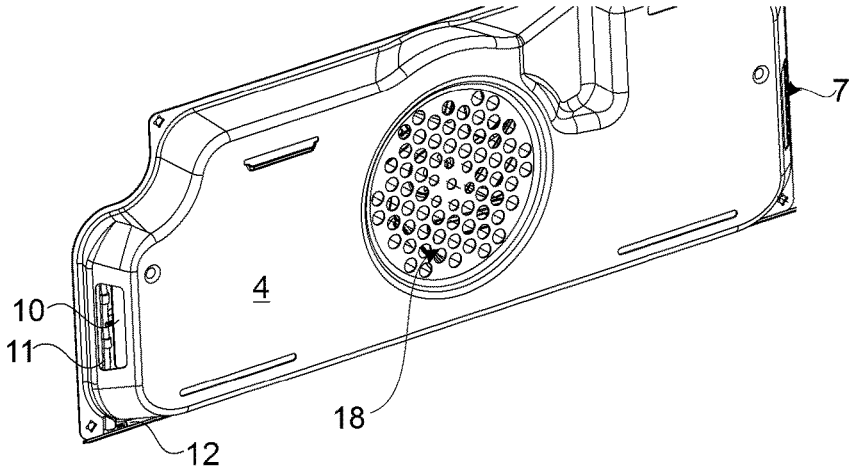

FIG. 8—is the rear view of the rear wall when the front of the passage is closed.

The elements illustrated in the figures are numbered as follows:

1. Oven
2. Cooking chamber
3. Fan
4. Rear wall
5. Separator
6. Compartment
7. Passage
8. Side wall
9. Side blowing hole
10. Lid

11. Shaft
12. Triggering arm
13. Resilient member
14. Recess
15. Connection member
16. Holder
17. Intermediate member
18. Rear blowing hole The oven (1) comprises a cooking chamber (2), at least one fan (3) that propels the air, a side wall (8) having at least one side blowing hole (9) that provides air to be delivered to the cooking chamber (2), a rear wall (4) that separates the cooking chamber (2) and the volume wherein the fan (3) is situated, at least one rear blowing hole (18) which is located on the rear wall (4) and provides air to be delivered to the cooking chamber (2), at least one separator (5) which can be mounted to and dismounted from the cooking chamber (2) and which divides the cooking chamber (2), at least two compartments (6) which are located in the cooking chamber (2) and separated from each other by the separator (5), and at least one passage (7) which provides the air flow from the volume wherein the fan (3) is situated to the side blowing holes (9).

The oven (1) of the present invention comprises at least one lid (10) which provides the air flow into the cooking chamber (2) through the side blowing holes (9) as the front of the passage (7) is opened when the separator (5) is placed into the cooking chamber (2), and which provides the front of the passage (7) to be closed when the separator (5) is removed from the cooking chamber (2). In order that different foods are cooked at different temperatures, the inner volume of the oven (1) is divided into two by means of the separator (5). The separator (5) is placed into the cooking chamber (2) by being pushed towards the rear wall (4) by the user. When the separator (5) gets closer to the rear wall (4), the lid (10) moves away from the passage (7). As the passage (7) is opened, air delivery to the side blowing holes (9) is provided. Thus, hot air is delivered to the compartment (6) wherein the side blowing holes (9) are located both from the rear by means of the rear blowing holes (18) and from the sides by means of the side blowing holes (9) and thus, a homogeneous cooking is provided to be performed in the compartment (6). When the separator (5) is removed from the cooking chamber (2), the front of the passage (7) is closed by means of the lid (10) and air flow through the side blowing holes (9) is prevented. Therefore, air is blown into the cooking chamber (2) only from the back (FIG. 1, FIG. 2, FIG. 3, FIG. 4).

In an embodiment of the present invention, the oven (1) comprises at least one triggering arm (12), which the separator (5) bears against when placed into the cooking chamber (2), and at least one shaft (11) which can rotate around its own axis and which is connected to the triggering arm (12). While getting closer to the rear wall (4), the separator (5) bears against the triggering arm (12). The triggering arm (12) moves by the separator (5) bearing against the triggering arm (12). Meanwhile, the lid (10) moves away from the front of the passage (7). Thus, the passage (7) is opened and air flow is provided from the volume wherein the fan (3) is situated to the side blowing holes (9), and air is provided to be blown into the cooking chamber (2) both from the back and from the sides. When the separator (5) is removed from the cooking chamber (2), the force applied by the separator (5) onto the triggering arm (12) is eliminated. Meanwhile, the lid (10) also rotates together with the shaft (11). The front of the passage (7) is closed by means of the lid (10) and air is blown into the cooking chamber (2) only from the back (FIG. 4, FIG. 5, FIG. 6).

In an embodiment of the present invention, the oven (1) comprises a connection member (15) that provides the shaft (11) to be mounted to the rear wall (4) and/or the side wall (8). The connection member (15) stands stationary on the rear wall (4) and/or the side wall (8) (FIG. 4, FIG. 5, FIG. 6).

In an embodiment of the present invention, the oven (1) comprises at least one intermediate member (17) located between the shaft (11) and the lid (10). Thus, depending on the movement of the shaft (11), the lid (10) moves, too (FIG. 4, FIG. 5, FIG. 6).

In an embodiment of the present invention, the oven (1) comprises at least one resilient member (13) located between the connection member (15) and the lid (10). While the separator (5) is placed into the cooking chamber (2), the shaft (11) and the intermediate member (17) move by means of the triggering arm (12) and by the movement of the intermediate member (17), the lid (10) moves away from the front of the passage (7). Meanwhile, the resilient member (13) between the stationary connection member (15) and the moving lid (10) is compressed. By the removal of the separator (5) from the cooking chamber (2), the pressure force applied by the separator (5) onto the triggering arm (12) is also eliminated. When the triggering arm (12) is released, the compressed resilient element (13) stretches and provides the lid (10) to move away from the front of the passage (7) (FIG. 5, FIG. 6).

In an embodiment of the present invention, the oven (1) comprises a resilient member (13) in the form of a spring.

In an embodiment of the present invention, the oven (1) comprises at least one recess (14) which is located on the rear wall (4) and wherein the triggering arm (12) is seated. While the user places the separator (5) into the cooking chamber (2), the triggering arm (12) is inserted into the recess (14). By the triggering arm (12) being completely inserted into the recess (14), the movement of the shaft (11) finally stops (FIG. 6, FIG. 7).

In an embodiment of the present invention, the oven (1) comprises at least one shaft (11) that extends in the vertical direction with respect to the triggering arm (12). The triggering arm (12) rotates as a result of the pressure applied onto the triggering arm (12) while the user places the separator (5) into the cooking chamber (2) and meanwhile, connected to the triggering arm (12), the shaft (11) rotates, too.

In an embodiment of the present invention, the oven (1) comprises at least one holder (16) which is located on the connection member (15) and through which the shaft (11) passes, and which provides the shaft (11) to be mounted to the connection member (15). The holder (16) both provides the shaft (11) to be borne into the connection member (15) and enables the shaft (11) to move inside the connection member (15) by rotating (FIG. 5, FIG. 6).

By means of the present invention, an oven (1) is realized wherein air is blown into the cooking chamber (2) both from the back and from the sides when the separator (5) is placed into the cooking chamber (2).

The invention claimed is:

1. An oven (1) comprising a cooking chamber (2), at least one fan (3) that propels the air, a side wall (8) having at least one side blowing hole (9) that provides air to be delivered to the cooking chamber (2), a rear wall (4) that separates the cooking chamber (2) and the volume wherein the fan (3) is situated, at least one rear blowing hole (18) which is located on the rear wall (4) and provides air to be delivered to the cooking chamber (2), at least one separator (5) which can be mounted to and dismounted from the cooking chamber (2) and which divides the cooking chamber (2), at least two compartments (6) which are located in the cooking chamber (2) and separated from each other by the separator (5), at least one passage (7) formed on the rear wall which opens into the volume wherein the fan is situated to provide the air flow from the volume wherein the fan (3) is situated to the side blowing holes (9), characterized by:

at least one lid (10) which provides the air flow into the cooking chamber (2) through the side blowing holes (9) as the front of the passage (7) is opened when the separator (5) is placed into the cooking chamber (2), and which provides the front of the passage (7) to be closed when the separator (5) is removed from the cooking chamber (2), and a triggering arm (12), which the separator (5) bears against when placed into the cooking chamber (2), and at least one shaft (11) which can rotate around its own axis and which is connected to the triggering arm (12).

2. The oven (1) as in claim 1, characterized by at least one connection member (15) that provides the shaft (11) to be mounted to the rear wall (4) and/or the side wall (8).

3. The oven (1) as in claim 2, characterized by at least one intermediate member (17) that is located between the lid (10) and the shaft (11).

4. The oven (1) as in claim 3, characterized by at least one resilient member (13) that is located between the lid (10) and the connection member (15).

5. The oven (1) as in claim 4, characterized by the resilient member (13) in the form of a spring.

6. The oven (1) as in claim 5, characterized by at least one recess (14) which is located on the rear wall (4) and wherein the triggering arm (12) is seated.

7. The oven (1) as in claim 6, characterized by at least one shaft (11) that extends in the vertical direction with respect to the triggering arm (12).

8. The oven (1) as in claim 7, characterized by at least one holder (16) which is located on the connection member (15) and through which the shaft (11) passes, and which provides the shaft (11) to be mounted to the connection member (15).

9. The oven (1) as in claim 1 characterized by at least one intermediate member (17) that is located between the lid (10) and the shaft (11).

10. The oven (1) as in claim 2, characterized by at least one resilient member (13) that is located between the lid (10) and the connection member (15).

11. The oven (1) as in claim 1 characterized by at least one recess (14) which is located on the rear wall (4) and wherein the triggering arm (12) is seated.

12. The oven (1) as in claim 2, characterized by at least one holder (16) which is located on the connection member (15) and through which the shaft (11) passes, and which provides the shaft (11) to be mounted to the connection member (15).

* * * * *